US005293716A

United States Patent [19]

Rothschild

[11] Patent Number: 5,293,716

[45] Date of Patent: Mar. 15, 1994

[54] GATE FOR TOLL SYSTEMS

[75] Inventor: Alexandre M. Rothschild, Port Washington, N.Y.

[73] Assignee: TDC Electronics, Inc., Bayside, N.Y.

[21] Appl. No.: 989,472

[22] Filed: Dec. 8, 1992

Related U.S. Application Data

[63] Continuation of Ser. No. 809,295, Dec. 17, 1991, abandoned.

[51] Int. Cl.[5] ..... E01F 13/00

[52] U.S. Cl. ..... 49/49; 49/9; 49/35; 49/334

[58] Field of Search ..... 49/49, 35, 34, 9, 334, 49/192

[56] References Cited

U.S. PATENT DOCUMENTS

| | | | |
|---|---|---|---|
| 1,578,587 | 3/1926 | Agostini | 49/334 X |
| 2,874,493 | 2/1959 | Mandel | 49/9 X |
| 4,364,200 | 12/1982 | Cobb | 49/49 X |
| 4,531,325 | 7/1985 | Phillips | 49/49 |
| 4,811,516 | 3/1989 | Anderson | 49/49 |
| 4,897,960 | 2/1990 | Barvinek et al. | 49/49 |
| 5,044,300 | 9/1991 | Herd | 49/49 X |
| 5,136,810 | 8/1992 | DeWitt, III | 49/49 |

*Primary Examiner*—Philip C. Kannan

*Attorney, Agent, or Firm*—Kane, Dalsimer, Sullivan, Kurucz, Levy, Eisele and Richard

[57] ABSTRACT

A gate bar for a toll gate apparatus includes a tubular member surrounded by a sleeve of resilient material. The sleeve is protected by a sheath which may be painted to improve the visibility of the bar.

14 Claims, 1 Drawing Sheet

GATE FOR TOLL SYSTEMS

This is a continuation of application Ser. No. 07/809,295 filed Dec. 17, 1991, now abandoned.

BACKGROUND OF INVENTION

1. Field of Invention

This invention pertains to toll gates and more particularly to an improved toll gate constructed of light yet sturdy materials.

2. Description the Prior Art

Toll systems are used principally to control access of vehicular traffic to bridges, tunnels, highways, to permit exit for example from a parking lot, and so on. Generally, a toll system includes a toll collecting station which may be manual or automatic and which may be used to collect a fee from a driver of the vehicle. During toll collecting, the path of the vehicle is blocked by a gate bar consisting essentially of an elongated member supported in a cantilevered manner and extending across the width of the lane. When the toll has been collected, a mechanism is activated to pivot the gate bar either vertically or horizontally to allow the vehicle to pass through. Conventional gate bars were constructed either of a heavy metal or wood. One major problem with such a gate is that if a toll gate attendant is careless while being in the vicinity of an operating gate, the gate may hit and cause injury to the attendant. In addition, if the gate malfunctions, or the vehicle is operated recklessly before the gate fully opens or closes, the gate may also damage the vehicle. A lighter gate made of styrofoam and plastic was also tried but it proved to be unacceptable because it was too flexible and was not strong enough.

OBJECTS AND SUMMARY OF THE INVENTION

In view of the above disadvantages of the prior art gates it is an objective of the present invention to provide a gate which is safe to operate thereby preventing injury.

A further objective is to provide a gate which is strong enough to resist normal wear and tear.

Other objectives and advantages shall become apparent from the following description. Briefly a gate bar constructed in accordance with this invention comprises a tubing made of relatively light material including a tubing made of metal, fiberglass, or a resin and encased in a resilient sleeve such as styrofoam. A protective sheath is provided on the sleeve.

BRIEF DESCRIPTION OF THE INVENTION

DETAILED DESCRIPTION OF THE INVENTION

Figure 1:
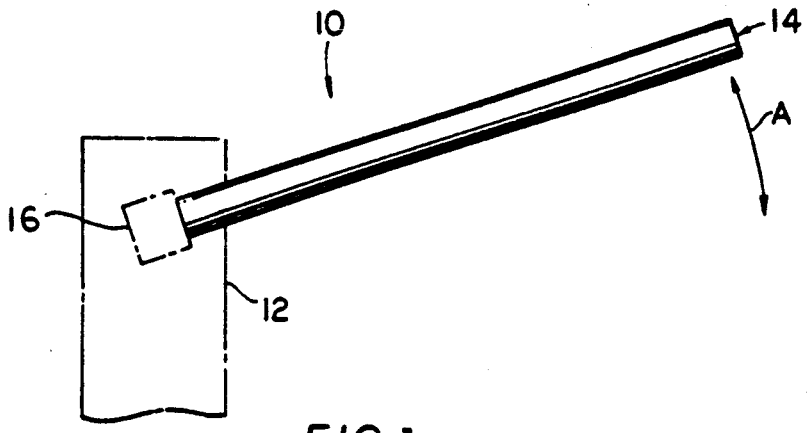
FIG. 1 shows a side sectional view of a gate bar constructed in accordance with this invention.
Figure 2:
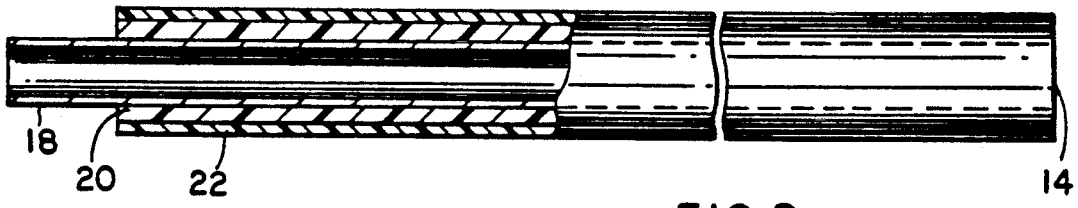
FIG. 2 shows a partial longitudinal sectional view of the gate bar of FIG. 1.
Figure 3:
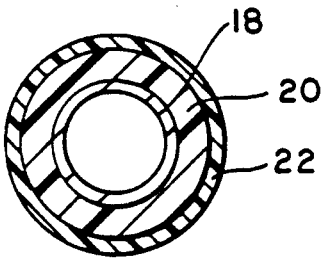
FIG. 3 shows a cross-sectional view of the gate bar of FIGS. 1 and 2.

Referring now to the drawings, a toll gate apparatus 10 includes an upright 12 which holds one end of a gate bar 14 by a pivoting mechanism 16. Mechanism 16 is used to raise or lower to bar 14 as shown by arrow A. Preferably gate bar 14 consists of a tubular element 18 having a diameter of about 1½" made for example of aluminum or another light metal or metal alloy. Alternatively, the element 18 may be made of a non-metallic material such as fiberglass or a resin. Element 18 is encased in a tubular sleeve 20 made of a light and resilient material such as styrofoam. Sleeve 20 has a thickness of about ¼" to 2" and is covered by a thin sheath of plastic 22 for protection. The sheath may also be painted and used as means of providing fluorescent markings on the bar so that the bar is highly visible at all times.

The advantage of this construction is that the resilient sleeve provides protection against injury or damage when the bar comes into contact with a person or a vehicle. Moreover, the structure is strong enough to withstand normal wear and tear, and it is inexpensive and easy to manufacture.

Obviously numerous modifications may be made to the invention without departing form its scope as defined in the appended claims.

What is claimed is:

1. Toll gate apparatus comprising;

an upright member:

a pivoting mechanism on said upright member; and a single gate bar connected directly at one end by said pivoting mechanism to said upright member, said gate bar comprising of and having a single tubing and a shock absorbing sleeve substantially coextensive with and surrounding said tubing, said sleeve being made of a resilient material having a thickness selected to avoid injury on impact with an object in any direction.

2. The apparatus of claim 1 further comprising a plastic sheath covering said sleeve.

3. The apparatus of claim 1 wherein said sleeve is made of styrofoam.

4. The apparatus of claim 1 wherein said tubing is made of a metal.

5. The apparatus of claim 1 wherein said tubing is made of fiberglass.

6. A toll gate comprising:

an upright;

pivoting means disposed on said upright; and a gate bar mounted on said upright by said pivoting means, said gate bar consisting of a hollow elongated tubing having one end directly connected to said pivoting means, a sleeve substantially coextensive with and surrounding said elongated tubing and made of a resilient material having a thickness selected to form a cushioning means for protection against injury on collision between said gate and an object in any directions, and a thin plastic sheath covering said sleeve for protection.

7. The gate of claim 6 wherein said tubing is made of a metal.

8. The gate of claim 6 wherein said tubing is made of aluminum.

9. The gate of claim 6 wherein said tubing is made of fiberglass.

10. The gate of claim 9 wherein said sleeve has a thickness in the range of ½" to 2".

11. The gate of claim 6 wherein said tubing is made of a resin.

12. The gate of claim 6 wherein said tubing has a diameter of about 1½".

13. A toll gate consisting of:

an upright;

pivoting means disposed on said upright; and and a gate bar formed on a hollow tubing having diameter of about 1½", said hollow tube having one end directly attached to said upright by said pivoting means; a sleeve disposed about and substantially coextensive with said tubing, said sleeve being made of shock absorbing material and having a thickness in the range of ½"-2½" selected to avoid injury on impact with an object in any direction; and a thin plastic sheath covering said sleeve for protection.

14. The gate of claim 13 wherein said sleeve is made of styrofoam.

* * * * *